US007101328B2

(12) United States Patent
Chiu

(10) Patent No.: US 7,101,328 B2
(45) Date of Patent: Sep. 5, 2006

(54) ABDOMINAL EXERCISE DEVICE

(76) Inventor: Lu-Ying Chiu, 15921 Sweet Pl., Hacienda Heights, CA (US) 91745

( * ) Notice: Subject to any disclaimer, the term of this patent is extended or adjusted under 35 U.S.C. 154(b) by 133 days.

(21) Appl. No.: 10/656,320

(22) Filed: Sep. 8, 2003

(65) Prior Publication Data

US 2005/0054498 A1 Mar. 10, 2005

(51) Int. Cl.
*A63B 26/00* (2006.01)
*A63B 71/00* (2006.01)

(52) U.S. Cl. ..... 482/140; 21/687

(58) Field of Classification Search ..... 482/140, 482/121, 130, 91–92, 62, 148, 123; D21/687–688
See application file for complete search history.

(56) References Cited

U.S. PATENT DOCUMENTS

| | | | | |
|---|---|---|---|---|
| D208,787 | S | 10/1967 | Bennstrom-Prescott | |
| 4,796,881 | A * | 1/1989 | Watterson | 482/73 |
| 4,844,448 | A * | 7/1989 | Niznik | 482/40 |
| 4,955,370 | A * | 9/1990 | Pettine | 602/28 |
| 5,071,119 | A | 12/1991 | Johnson | |
| 5,176,601 | A * | 1/1993 | Reynolds | 482/130 |
| 5,224,914 | A * | 7/1993 | Friedman | 482/127 |
| 5,441,473 | A * | 8/1995 | Safani et al. | 482/130 |
| 5,669,862 | A | 9/1997 | Sayman | |
| 5,833,582 | A * | 11/1998 | Chen | 482/57 |
| 5,964,685 | A | 10/1999 | Boland | |
| 6,056,676 | A | 5/2000 | Adams | |
| 6,080,090 | A * | 6/2000 | Taylor et al. | 482/121 |
| 6,110,078 | A * | 8/2000 | Dyer | 482/79 |
| 6,290,630 | B1 * | 9/2001 | Boland | 482/130 |
| 6,296,598 | B1 | 10/2001 | Boland | |
| 6,312,366 | B1 * | 11/2001 | Prusick | 482/130 |
| 6,390,960 | B1 * | 5/2002 | Boland | 482/140 |
| 6,520,891 | B1 * | 2/2003 | Stephens, Jr. | 482/54 |
| 6,634,997 | B1 * | 10/2003 | Breibart et al. | 482/130 |
| 6,971,975 | B1 * | 12/2005 | Croft | 482/121 |
| 2004/0053757 | A1 * | 3/2004 | Chung | 482/140 |
| 2004/0138029 | A1 * | 7/2004 | Brausen | 482/51 |
| 2004/0138034 | A1 * | 7/2004 | Endelman | 482/121 |
| 2005/0239616 | A1 * | 10/2005 | Tuller et al. | 482/121 |
| 2005/0245370 | A1 * | 11/2005 | Boland | 482/130 |

FOREIGN PATENT DOCUMENTS

| | | | |
|---|---|---|---|
| FR | 2554356 A1 * | 5/1985 | |

* cited by examiner

*Primary Examiner*—Lori Amerson

(57) ABSTRACT

An abdominal exercise device for exercising the stomach while seated includes a first frame portion for abutting against an upper surface of the legs of a person and includes an elongated rear member, an elongated front member and a pair of elongated side members attached together. A second frame portion for abutting against the torso includes a pair of legs and an elongated central member attached together such that the second frame portion generally has a U-shape. Each of a pair of coupling members pivotally couples free ends of the pair of legs to the first frame portion at junctures of the rear member and the pair of side members. A pair of biasing members biases the central portion away from the front member such that the first frame portion lies in a plane orientated perpendicular to a plane of the second frame portion.

5 Claims, 4 Drawing Sheets

ABDOMINAL EXERCISE DEVICE

BACKGROUND OF THE INVENTION

1. Field of the Invention

The present invention relates to stomach muscle exercising devices and more particularly pertains to a new stomach muscle exercising device for exercising stomach muscles while in a seated position.

2. Description of the Prior Art

The use of stomach muscle exercising devices is known in the prior art. However, these devices are not generally well suited for use while in a seated position, such as behind a desk. Additionally, these devices are not easily stored when not in use. Though these devices due suit their intended purposed, the need remains for a device that is easier to use while in a chair and that is easy to store.

SUMMARY OF THE INVENTION

The present invention meets the needs presented above by providing a pair of frames pivotally coupled together and biased apart so that a user of the device exercises their stomach by forcing the frames together while in a seated position.

Another object of the present invention is to provide a new stomach muscle exercising device that includes biasing members that are removable from the device so that the device may be folded relatively flat for easy storage on the side of or underneath a desk.

To this end, the present invention generally comprises a first frame portion for abutting against an upper surface of the legs of a person. The first frame portion includes an elongated rear member, an elongated front member and a pair of elongated side members attached together. A second frame portion for abutting against the torso includes a pair of legs and an elongated central member attached together such that the second frame portion generally has a U-shape. Each of a pair of coupling members pivotally couples free ends of the pair of legs to the first frame portion at junctures of the rear member and the pair of side members. A pair of biasing members biases the central portion away from the front member such that the first frame portion lies in a plane orientated perpendicular to a plane of the second frame portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
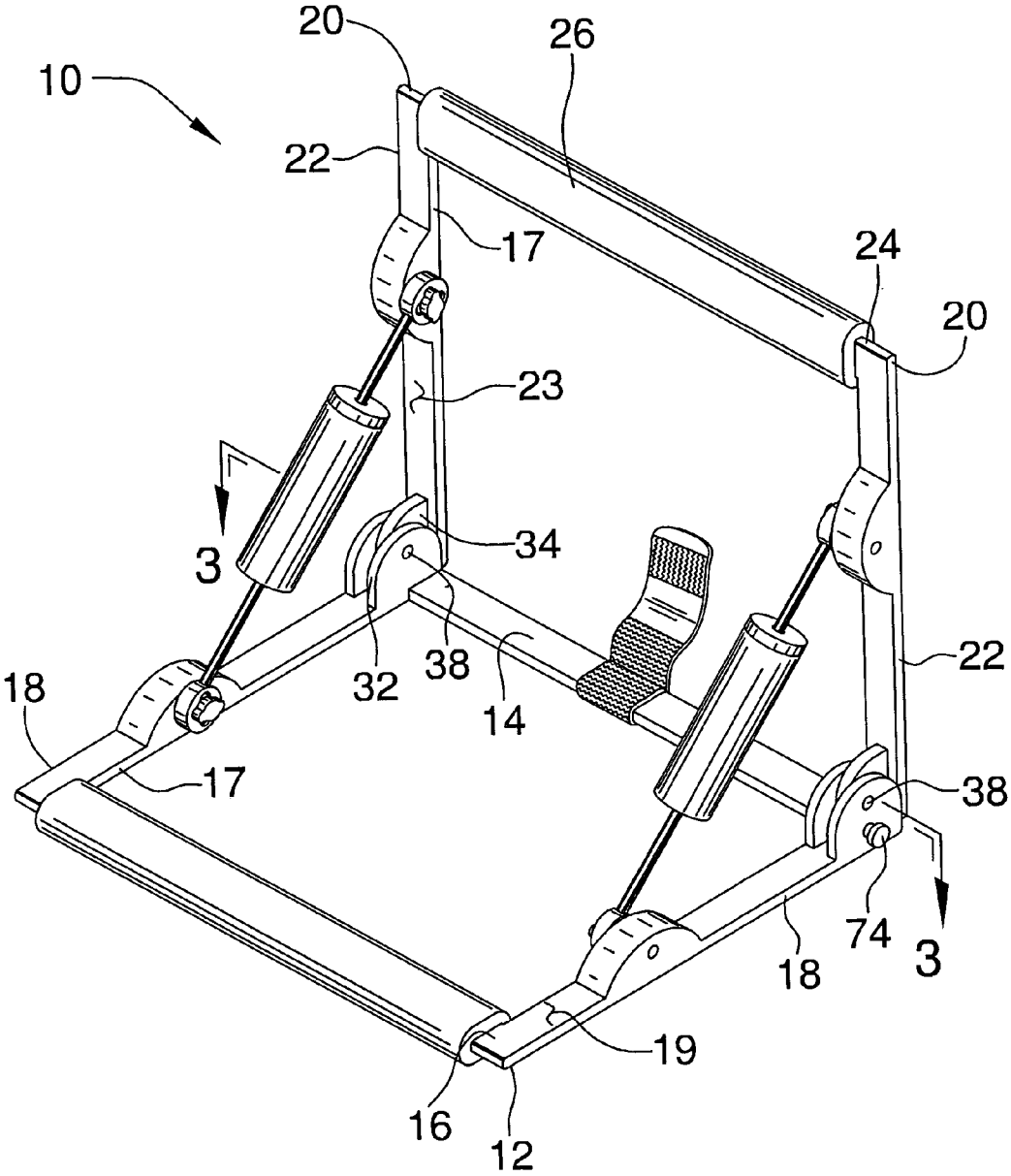
FIG. 1 is a schematic perspective view of a abdominal exercise device according to the present invention.

With reference now to the drawings, and in particular to FIGS. 1 through 6 thereof, a new stomach muscle exercising device embodying the principles and concepts of the present invention and generally designated by the reference numeral 10 will be described.

As best illustrated in FIGS. 1 through 6, the abdominal exercise device 10 generally comprises a first frame portion 12 for abutting against an upper surface of the legs 7 of a person 6 who is using the device 10. The first frame portion 12 includes an elongated rear member 14, an elongated front member 16 and a pair of elongated side members 18 attached together such that the first frame portion 12 has a substantially rectangular shape. A second frame portion 20 is abuttable against the torso 8 of the person 6 and includes a pair of legs 22 and an elongated central member 24 attached together such that the second frame portion 20 generally has a U-shape. Ideally, a cushioning material 26 is wrapped around and substantially covers the front member 16 and the central member 24.

Each of a pair of coupling members 30 pivotally couples free ends 28 of the pair of legs 22 to the first frame portion 12 at junctures of the rear member 14 and the pair of side members 18. Each of the coupling members 30 includes a first bracket 32 attached to an upper surface 19 of one of the side members 18 and a second bracket 34 attached to a front surface 23 of one of the legs 22. Each one of a pair of pins 38 is extending through an aligned one of the first 32 and second brackets 34 such that the first 32 and second 34 brackets are pivotally coupled together. The first brackets 32 each preferably include a pair of parallel orientated and spaced walls 40. Each of the walls 40 lies in a plane orientated substantially parallel to a longitudinal axis of a respective one of the side members 18. The second brackets 34 each include a plate 42 lying in a plane orientated parallel to a longitudinal axis of a respective one of the legs 22. Each of the plates 42 is positionable between one of the pair of walls 40. The pins 38 are each extended through the walls 40 and an associated one of the plates 42 such that the pins 38 are orientated generally perpendicular to the longitudinal axis of the side members 18. A washer 39 may be positioned on the pin for retaining its position.

A pair of biasing members 44 biases the central portion 24 away from the front member 16 such that the first frame portion 12 lies in a plane orientated perpendicular to a plane of the second frame portion 20. Each of the biasing members 44 has a first end 46 removably and pivotally coupled to one of the legs 22 and a second end 48 removably and pivotally coupled to one of the side members 18 such that each of the biasing members 44 is orientated substantially parallel to each other. The biasing members 44 each include a cylinder 50 having first wall 51, a second wall 52 and a peripheral wall 53 extending between the first 51 and second 52 walls. The peripheral wall 53 has a break therein such that the cylinder 50 includes a pair of sections selectively coupled together. The sections are preferably coupled together with male and female threaded areas 54 of the peripheral wall 53. A first rod 55 is attached to the first wall 51 and extends away therefrom. The first rod 55 has a free end defining the first end 46 of the biasing members 44. A second rod 56 extends slidably through the second wall 52. The second rod 56 has an inner end defining a piston 57 and a free defining the second end 48. The piston 57 is positionable in the cylinder 50. When the piston 57 is positioned against the second wall 52, the device 10 has an overall perpendicular orientation as shown in FIG. 1. A spring 58 is positioned in the cylinder 50 and is located between the piston 57 and the first wall 51 when the sections of the cylinder 50 are coupled together. The spring 58 is easily removable so that it may be replaced with alternate springs having a different tension.

Conventional fasteners 60, such as bolts and screws, may be used for removably attaching the first 46 and second 48 ends of the biasing members 44 to the first 12 and second 20 frame portions. The first 46 and second 48 ends preferably rotate on the fasteners 60. Preferably, the fasteners 60 are rotatably coupled to the frame portions 12, 20 and include heads 62 that are extendable through apertures 64 in the first 46 and second 48 ends. The heads 62 and apertures 64 each have an elongated shape so that the heads 62 may be turned to secure the first 46 and second ends 48 to the frame portions 12, 20. Ideally, the biasing members 44 are attached to inner peripheral edges 17 of the first 12 and second 20 frame portions to reduce the risk of injury to the person because of movement of biasing members. Also, it is preferred that the first 46 and second 48 ends be attached to raised portions 64 on the side members 18 and legs 22 to space the first 46 and second 48 ends from the legs 7 and torso 8 of the person 6. The raised portions 64 may not be necessary depending on the thickness of the first 12 and second 20 frame portions, though it is desire to keep the weight of the device 10 relatively low and thus generally thin frame portions are preferred.

Figures 5, 6:
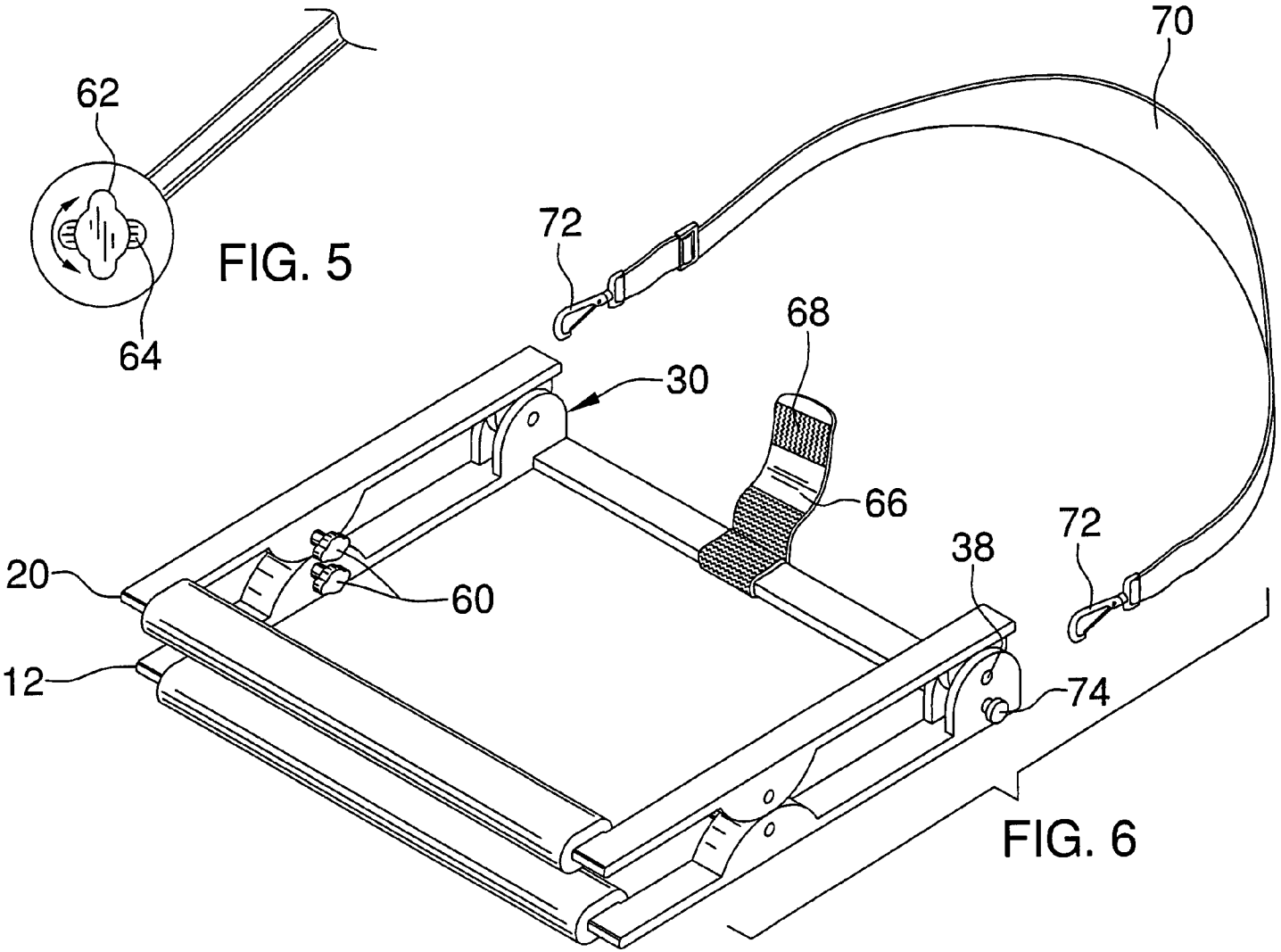
FIG. 5 is a schematic side view of a rod of the biasing member of the present invention.
FIG. 6 is a schematic perspective view of the present invention.

Preferably included is a securing member for selectively securing the first frame portion 12 to a waist of the person 6 so that the rear portion 14 abuts a juncture of the torso 8 and the legs 7 of the user. The securing member includes a strap 66 attached to the rear member 14 for securing the rear member 14 to a belt being worn by the person. A hook and loop fastener 68 may be used for securing the strap 66 to itself. An additional, or alternate, securing member is shown in FIG. 6 and includes an elongated flexible member 70 having a pair of ends each having a clip thereon 72. The flexible member is wrapped around the body of the person and the clips 72 attached to protuberances 74 on the first frame portion 12 of the device 10. Ideally, the flexible member 70 has an adjustable length.

Figure 2:
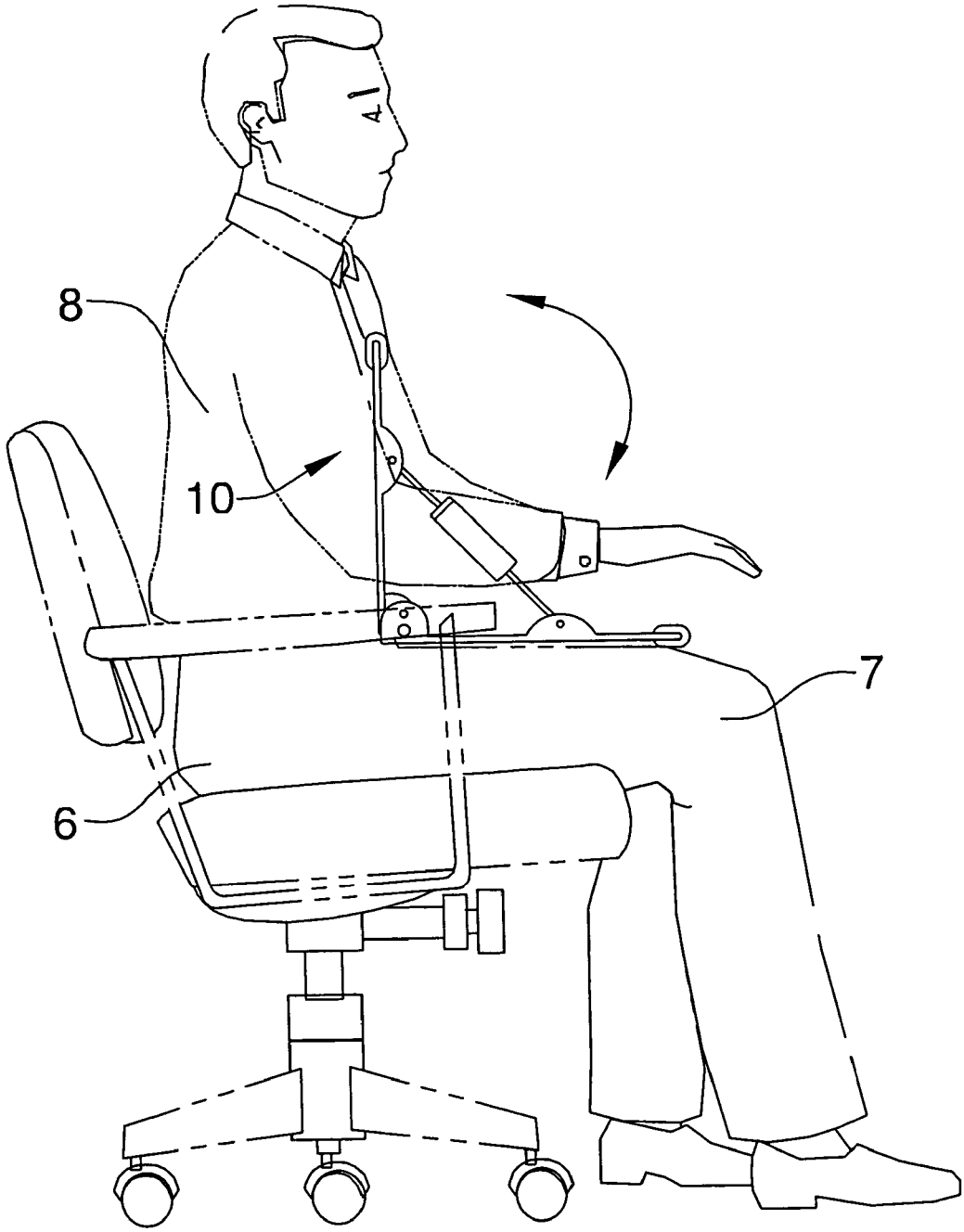
FIG. 2 is a schematic side view of the present invention.
Figure 3:
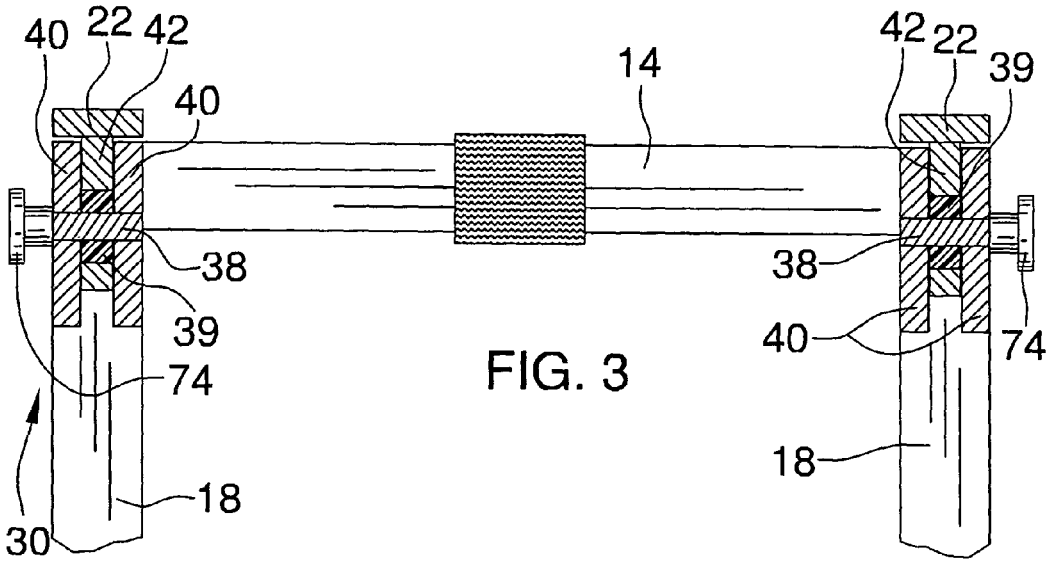
FIG. 3 is a schematic cross-sectional view taken along line 3—3 of FIG. 1 of the present invention.
Figure 4:
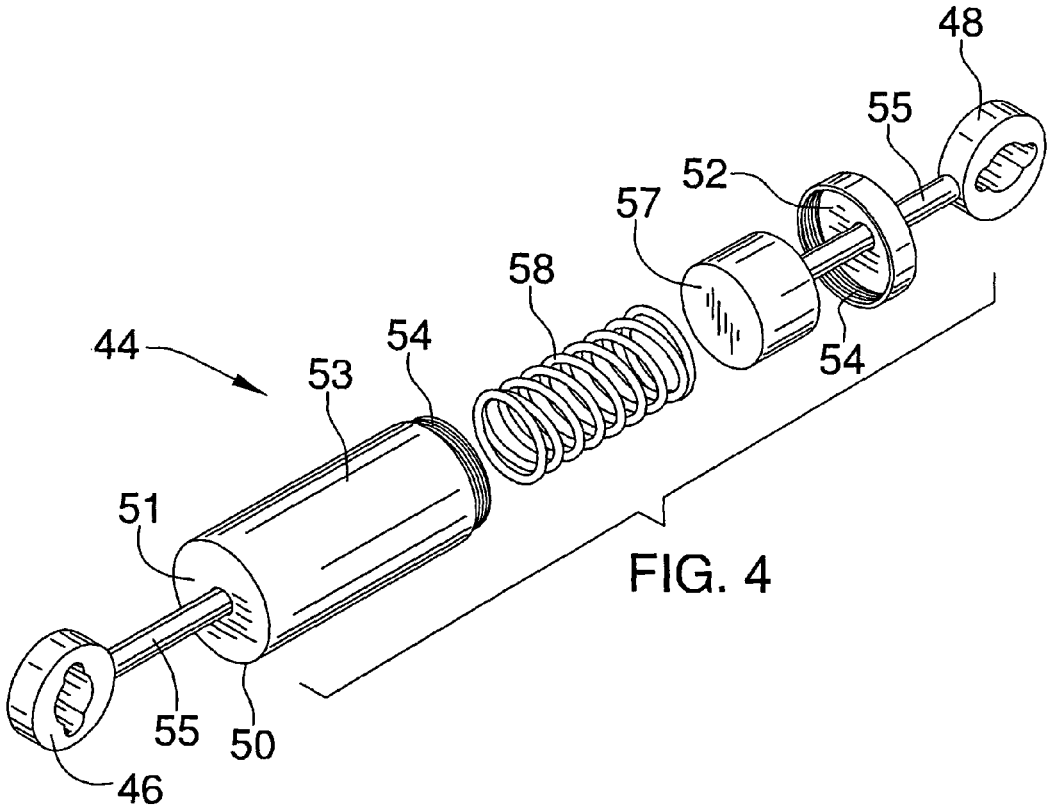
FIG. 4 is a schematic perspective expanded view of a biasing member of the present invention.

In use, the device 10 is positioned on the lap of the person as indicated in FIG. 2. The device 10 is attached to the person with the securing member. The person presses their torso 8 toward their legs 7 to compress the springs 58. This movement exercises the stomach muscles without putting strain on the neck or requiring the person to lie on a floor surface. The springs 58 may be changed as desired to increase or decrease the resistance of the device on the stomach muscles. When not in use, the biasing members 44 may be removed and device folded as shown in FIG. 5.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An abdominal exercise device for positioning at the juncture of a torso and legs of a seated person and resisting movement of the torso toward the legs, said device comprising:

a first frame portion for abutting against an upper surface of the legs, said first frame portion including an elongated rear member, an elongated front member and a pair of elongated side members attached together;

a second frame portion for abutting against the torso includes a pair of legs and an elongated central member attached together such that said second frame portion generally has a U-shape;

each of a pair of coupling members pivotally coupling free ends of said pair of legs to said first frame portion at junctures of said rear member and said pair of side members, each of said coupling members including a first bracket attached to an upper surface of one of said side members and a second bracket attached to a front surface of one of said legs a pin extending through said aligned ones of said first and second brackets such that said first and second brackets are pivotally coupled together; and a pair of biasing members for biasing said central portion away from said front member such tat said first frame portion lies in a plane orientated perpendicular to a plane of said second frame portion, each of said biasing members has a first end removably and pivotally coupled to one of said legs and a second end removably and pivotally coupled to one of said side members such tat each of said biasing members is orientated substantially parallel to each other, each of said biasing members including;

a cylinder having first wall, a second wall and a peripheral wall extending between said first and second walls, said peripheral wall having a break therein such that said cylinder including a pair of sections selectively coupled together;

a first rod being attached to said first wall and extending away therefrom, said first rod having a free end defining said first end;

a second rod extending through said second wall, said second rod having an inner end defining a piston and a free defining said second end, said piston being positionable in said cylinder; and a spring being positioned in said cylinder and being located between said piston and said first wall when said pair of sections are coupled together.

2. The abdominal exercise device of claim 1, wherein said first brackets each include a pair of parallel orientated and spaced walls, each of said walls lying in plane orientated substantially parallel to a longitudinal axis of a respective one of said side members, said second brackets each including a plate lying in a plane orientated parallel to a longitudinal axis of a respective one of said legs, each of said plates being positionable between one of said pair of walls, each of said pins being extended through said walls and an associated one of said plates such that said pins are orientated generally perpendicular to said longitudinal axis of said side members.

3. The abdominal exercise device of claim 1, further including a cushioning material being wrapped around and substantially covering said front member and said central member.

4. The abdominal exercise device of claim 1, further including a securing member selectively secures said first frame portion to a waist of the person such that said rear portion abuts the juncture of the torso and the legs.

5. An abdominal exercise device for positioning at the juncture of a torso and legs of a seated person and resisting movement of the torso toward the legs, said device comprising:

a first frame portion for abutting against an upper surface of the legs, said first frame portion including an elongated rear member, an elongated front member and a pair of elongated side members attached together such that said first frame portion has a substantially rectangular shape;

a second frame portion for abutting against the torso includes a pair of legs and an elongated central member attached together such that said second frame portion generally has a U-shape;

each of a pair of coupling members pivotally coupling free ends of said pair of legs to said first frame portion at junctures of said rear member and said pair of side members, each of said coupling members including a first bracket attached to an upper surface of one of said side members and a second bracket attached to a front surface of one of said legs, each one of a pair of pins extending through an aligned one of said first and second brackets such that said first and second brackets are pivotally coupled together, said first brackets each including a pair of parallel orientated and spaced walls, each of said walls lying in a plane orientated substantially parallel to a longitudinal axis of a respective one of said side members, said second brackets each including a plate lying in a plane orientated parallel to a longitudinal axis of a respective one of said legs, each of said plates being positionable between one of said pair of walls, each of said pins being selectively extended through said walls and an associated one of said plates such that said pins are orientated generally perpendicular to said longitudinal axis of said side members;

a pair of biasing members for biasing said central portion away from said front member such that said first frame portion lies in a plane orientated perpendicular to a plane of said second frame portion, each of said biasing members having a first end removably and pivotally coupled to one of said legs and a second end removably and pivotally coupled to one of said side members such that each of said biasing members is orientated substantially parallel to each other, each of said biasing members including;

a cylinder having first wall, a second wall and a peripheral wall extending between said first and second walls, said peripheral wall having a break therein such that said cylinder including a pair of sections selectively coupled together;

a first rod being attached to said first wall and extending away therefrom, said first rod having a free end defining said first end;

a second rod extending through said second wall, said second rod having an inner end defining a piston and a free defining said second end, said piston being positionable in said cylinder;

a spring being positioned in said cylinder and being located between said piston and said first wall when said pair of sections are coupled together;

a cushioning material being wrapped around and substantially covering said front member and said central member; and a securing member selectively secures said first frame portion to a waist of the person such that said rear portion abuts the juncture of the torso and the legs.

* * * * *